US005886311A

United States Patent [19]

Morel et al.

[11] Patent Number: 5,886,311

[45] Date of Patent: Mar. 23, 1999

[54] MULTIPOLE ELECTRICAL SWITCH HAVING ONE ELEMENTARY SWITCHING BAR PER POLE

[75] Inventors: Robert Morel, Eybens; Henri Auque, Uriage; Philippe Hartmann, Grenoble; Denis Vial, Fontaine; Michel Faure, Saint Paul De Varces, all of France

[73] Assignee: Schneider Electric SA, France

[21] Appl. No.: 927,928

[22] Filed: Sep. 11, 1997

[30] Foreign Application Priority Data

Sep. 16, 1996 [FR] France ..... 96 11456

[51] Int. Cl.[6] ..... H01H 3/32

[52] U.S. Cl. ..... 200/17 R; 200/50.32

[58] Field of Search ..... 200/1 R, 11 R, 200/14, 11 TC, 17 R, 18, 50.32, 50.33, 50.34, 564, 570, 571, 573, 501, 336, 337

[56] References Cited

U.S. PATENT DOCUMENTS

| | | | |
|---|---|---|---|
| 3,609,267 | 9/1971 | Egorov et al. | 200/155 |
| 4,412,116 | 10/1983 | Golub | 200/155 R |
| 4,778,961 | 10/1988 | M'Sadoques et al. | 200/17 R |
| 5,416,291 | 5/1995 | Venzke | 200/17 R |
| 5,686,709 | 11/1997 | Casagrande et al. | 200/50.32 |

FOREIGN PATENT DOCUMENTS

| | | | |
|---|---|---|---|
| 0100699 | 2/1984 | European Pat. Off. | H01H 1/20 |
| 2017053 | 8/1969 | France | H01H 19/00 |
| 2211734 | 7/1974 | France | H01H 19/00 |
| 2637341 | 4/1990 | France | F16H 21/14 |
| 51193 | 3/1890 | Germany . | |
| 326973 | 10/1920 | Germany . | |
| 668433 | 12/1938 | Germany . | |
| 2648670 | 5/1978 | Germany | H01H 31/12 |
| 123188 | 11/1967 | Netherlands | H01H 19/58 |

*Primary Examiner*—Michael A. Friedhofer
*Attorney, Agent, or Firm*—Parkhurst & Wendel

[57] ABSTRACT

A multipole switch comprises a plurality of single-pole switch modules arranged side by side in compartments of the insulating case. Each switch module comprises an individual switching bar supporting the movable contact, said bar being formed by a vertical-axis rotary insulating stud having an end-piece for guiding in rotation at one of its ends, and driving means at the other end. A pair of actuating rods is mechanically coupled to the driving means of all the switching bars, and cooperates with connecting rods of the operating mechanism to perform movement of the actuating rods in translation in opposite directions when moving from the open position to the closed position, and vice-versa, said elongate actuating rods extending parallel to one another in a horizontal plane perpendicular to the different rotary studs.

10 Claims, 5 Drawing Sheets

FIG. 6
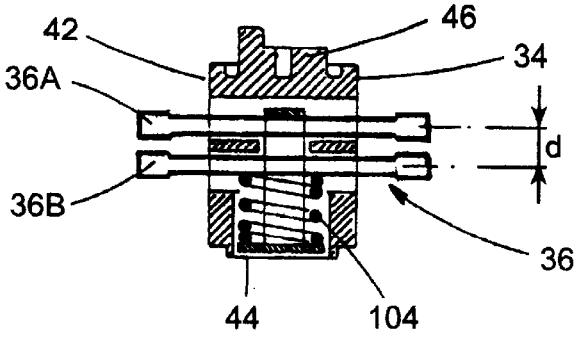
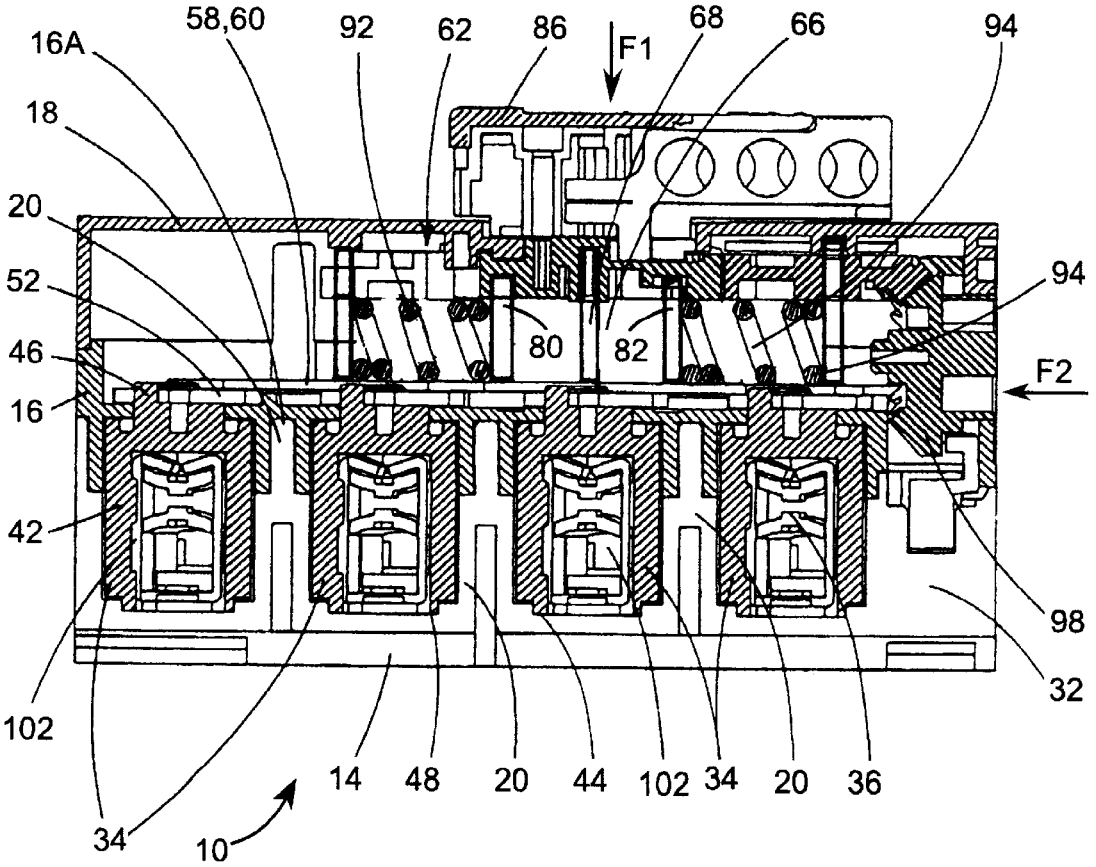
FIG. 5

MULTIPOLE ELECTRICAL SWITCH HAVING ONE ELEMENTARY SWITCHING BAR PER POLE

BACKGROUND OF THE INVENTION

The invention relates to a multipole electrical switch with a parallelepipedic case made of molded insulating material, housing:

an operating mechanism common to the set of poles to bring about opening and closing of the switch, a plurality of single-pole switch modules arranged side by side in adjacent compartments isolated from one another by separating partitions, each module being equipped with a movable contact in the form of a bridge cooperating with a pair of opposite stationary contacts to generate a double current interruption per pole, and transmission means designed to move the movable contacts of all the switch modules simultaneously by the action of the operating mechanism.

Known transmission means of the movable contacts of the set of poles comprise either a switching slide movable in translation by means of an operating mechanism positioned on the lateral side (FR-A-2,530,373), or a common rotary bar actuated by a rod of a toggle. The use of a slide or a rotary shaft supporting all the movable contacts imposes constraints of positioning and architecture and requires different embodiments according to whether the type is four-pole or three-pole.

SUMMARY OF THE INVENTION

The object of the invention is to achieve a multipole switch which is quick to assemble, using a maximum number of standard elements to go from a three-pole version to a four-pole version.

The switch according to the invention is characterized in that:

each switch module comprises an individual switching bar supporting the movable contact, said bar being formed by a vertical-axis rotary insulating stud having an end-piece for guiding in rotation at one of its ends, and driving means at the other end, and a pair of actuating rods is mechanically coupled to the driving means of all the switching bars and cooperates with connecting rods of the operating mechanism to perform movement of the actuating rods in translation in opposite directions when moving from the open position to the closed position, and vice-versa, said elongate actuating rods extending parallel to one another in a horizontal plane perpendicular to the different rotary studs.

The driving means of each elementary switching bar comprise a driving lug arranged at the upper end of the stud, and a transmission ring surrounding said lug and having in addition two pins inserted in holes arranged in the actuating rods.

According to a preferred embodiment, the two actuating rods work respectively in traction and in compression following the action of the connecting rods on one of the rings of an intermediate pole.

According to a feature of the invention, the connecting rods comprise upper ends positioned in gorges of a main pinion of the pinion device.

The main pinion is in mechanical connection with a conical pinion by means of a counterpinion, and a removable operating handle can be fitted either to the main pinion or to the conical pinion to achieve front control or lateral control.

The case is advantageously formed by superposition of a base housing the compartments of the single-pole modules, an intermediate housing containing the drive means of the studs and the actuating rods, and a cover for positioning of the operating mechanism.

All the single-pole switching bars have identical structures each bearing a double movable contact arranged as a bridge formed by two parallel conducting bars passing through apertures of the insulating stud, and separated from one another by a preset gap, and cooperating on one side with a first stationary contact in connection with one of the connection terminals, and on the opposite side with a second stationary contact in connection with the other connection terminal of each pole.

BRIEF DESCRIPTION OF THE DRAWINGS

Other advantages and features will become more clearly apparent from the following description of an embodiment of the invention given as a non-restrictive example only and represented in the accompanying drawings in which:

FIG. 5 is a vertical cross-sectional view of the switch in the assembled position;

FIG. 6 represents a schematic view of a single-pole switching bar.

DETAILED DESCRIPTION OF THE PREFERRED EMBODIMENT

Figure 1:
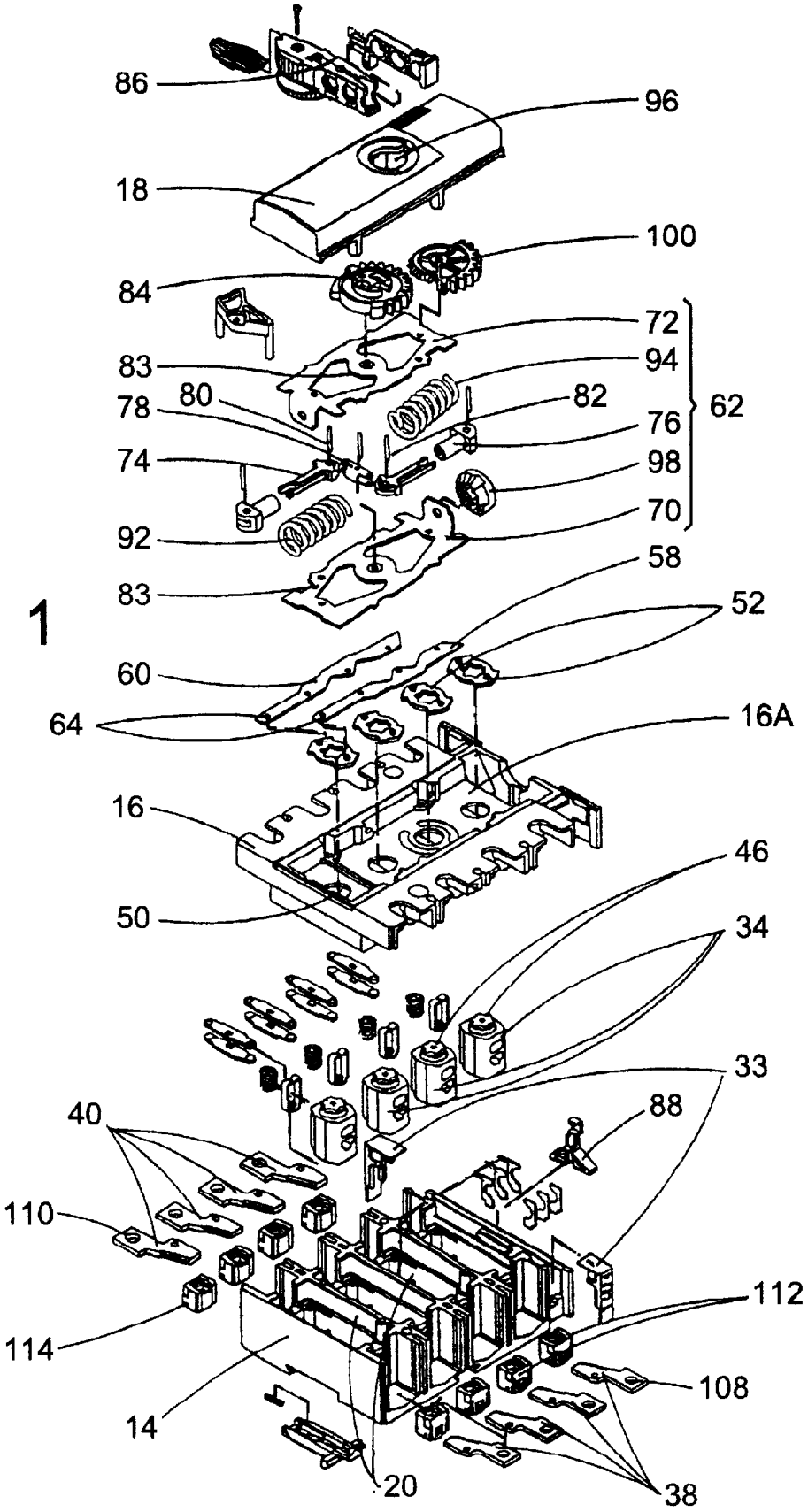
FIG. 1 is an exploded perspective view of the multipole switch according to the invention.
Figure 2:
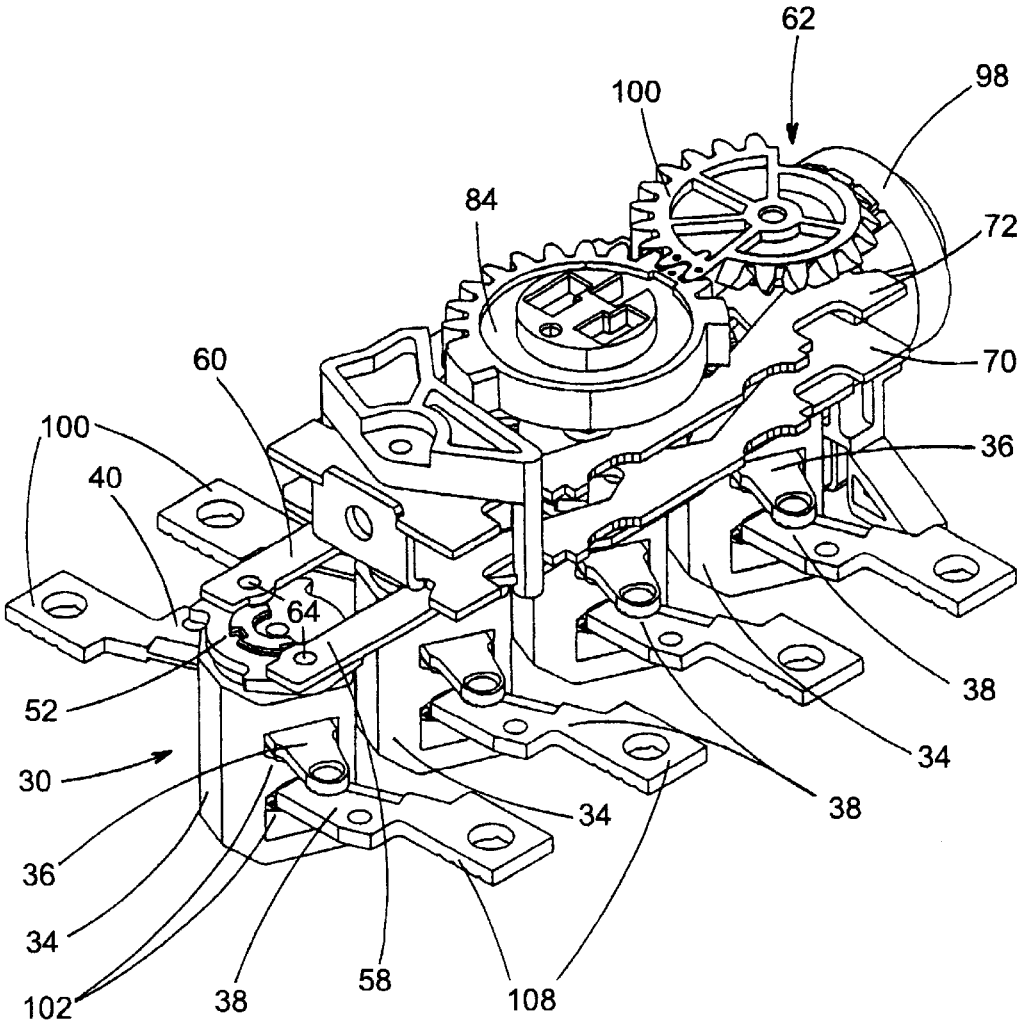
FIG. 2 shows a perspective view of the movable assembly coupled to the operating mechanism, the switch case not being represented.

With reference to FIGS. 1 to 6, a low-voltage, high-rating, multipole electrical switch 10 is housed in a parallelepipedic case 12 made of molded insulating material formed by superposition of a base 14, an intermediate housing 16, and a cover 18.

The internal volume of the base 14 is subdivided by parallel partitions 20 into several compartments 22, 24, 26, 28 for housing single-pole switch modules 30 arranged side by side in the case 12. To the right of the compartment 28 there is an additional compartment 32 able to be used for fitting of electrical indication auxiliaries 33 for indication of the open or closed position. The width of the additional compartment 32 is smaller than that of each compartment 22, 24, 26, 28 of the switch modules 30.

The single-pole switch modules 30 are identical and constitute the different poles of the switch 10 which, in the example described, is a four-pole switch. Each single-pole switch module 30 comprises an individual rotary switching bar 34 equipped with a double movable contact 36 in the form of a bridge (FIG. 6) cooperating with two opposite stationary contacts 38, 40 (FIGS. 2 and 4) to create a double current interruption per pole.

The vertical-axis rotary switching bar 34 of each pole is formed by a stud 42 made of insulating material, provided with a cylindrical end-piece 44 at its lower end, and with a driving lug 46 at its upper end. The end-piece 44 is housed in a blind notch 48 of circular cross-section arranged in the bottom of the base 14 to constitute a part for guiding in rotation or a bearing situated in the middle zone of the compartment 22, 24, 26, 28 of the corresponding pole. The height of the insulating stud 42 is slightly greater than the vertical clearance between the bottom of the base 14 and the horizontal wall 16A of the intermediate housing 16. The driving lug 46 passes through a circular orifice 50 provided in the horizontal wall 16A of the housing 16 and is coupled at the level of each pole to a transmission ring 52, which is provided with two diametrically opposite pins 54, 56. The lug 46 and transmission ring 52 constitute the means for driving the bar 34.

The elementary switching bars 34 of all the poles extend parallel to one another in a vertical direction perpendicular to the wall 16A, and are staggered at regular intervals, being moved in limited rotation by means of two actuating rods 58, 60 controlled by an operating mechanism 62. The two elongate rods 58, 60 are positioned parallel to one another on the upper face of the horizontal wall 16A of the housing 16, and each comprises a series of circular holes 64 into which the pins 54, 56 of the different transmission rings 52 penetrate.

The operating mechanism 62 is common to all the bars 34 of the single-pole modules 30 and is arranged in the cover 18. It comprises a double toggle device 66 associated to a pinion device 68 with front or lateral actuation. The double toggle device 66 is arranged between two metal flanges 70, 72 parallel to the wall 16A and is composed of two pivoting levers 74, 76 articulated on one another by means of an intermediate lever 78 (FIG. 1). The two articulations of the double toggle 66 have passing through them without clearance two parallel connecting rods 80, 82 protruding out on each side of the flanges 70, 72 and being in contact with a circular sector 83 of the flanges. The upper ends of the connecting rods 80, 82 are positioned in drive gorges of a main operating pinion 84 which is actuated in rotation by an operating handle 86 accessible from the outside.

The lower ends of the two connecting rods 80, 82 cooperate with two bearing surfaces of an intermediate ring 52 to move the actuating rods 58, 60 in opposite translation directions when the toggle 66 changes state caused by pivoting of the operating handle 86 in the opening or closing direction. A compression spring 92, 94 is threaded onto each lever 74, 76 of the toggle device 66 and bears on the corresponding connecting rod 80, 82.

When front operation is involved, the operating handle 86 is coupled directly to the main pinion 84 after having been inserted according to the arrow F1 through an orifice 96 of the cover 18 (FIG. 5).

Lateral operation is also possible by coupling the operating handle 86 to a conical pinion 98 according to the direction of the arrow F2. The rotational movement of the conical pinion 98 is transmitted to the main pinion 84 by means of a counterpinion 100. In this case, the orifice 96 is free and enables a position detector (not represented) to be fitted enabling visual checking of the closed or open state of the multipole switch 10.

Actuation of the electrical indication auxiliaries 33 takes place at the end of the rotational travel of the lateral conical pinion 98 by means of a slide 88.

The double movable contact 36 of each switching bar 34 comprises two parallel conducting bars 36A, 36B passing through opposite apertures 102 of the stud 42, and separated from one another by a preset gap d (FIG. 6). A contact pressure spring 104 is arranged inside the stud 42, extending perpendicularly to the bar 36B.

The double contact bridge 36 of each pole cooperates on one side with the first stationary contact 38 and on the opposite side with the other stationary contact 40. Each pair of contacts 36, 38; 36, 40 has an associated arc extinguishing chamber 106 with deionization plates.

The two stationary contacts 38, 40 of each switch module 30 are both extended by a connection strip 108, 110 cooperating respectively with a connection terminal tunnel 112, 114. The cross-section of the bars 36A, 36B constituting the double movable contact 36 may be cylindrical or rectangular.

Operation of the multipole switch 10 according to FIGS. 2 to 5 is as follows: In the closed position depicted in FIGS. 2 and 4, the stationary contact 38, 40 of each pole is inserted between the grips of the two bars 36A, 36B of the double movable contact 36. The edge of the stationary contacts 38, 40 is advantageously beveled for ease of entry of the grip at the end of closing travel.

Figure 3:
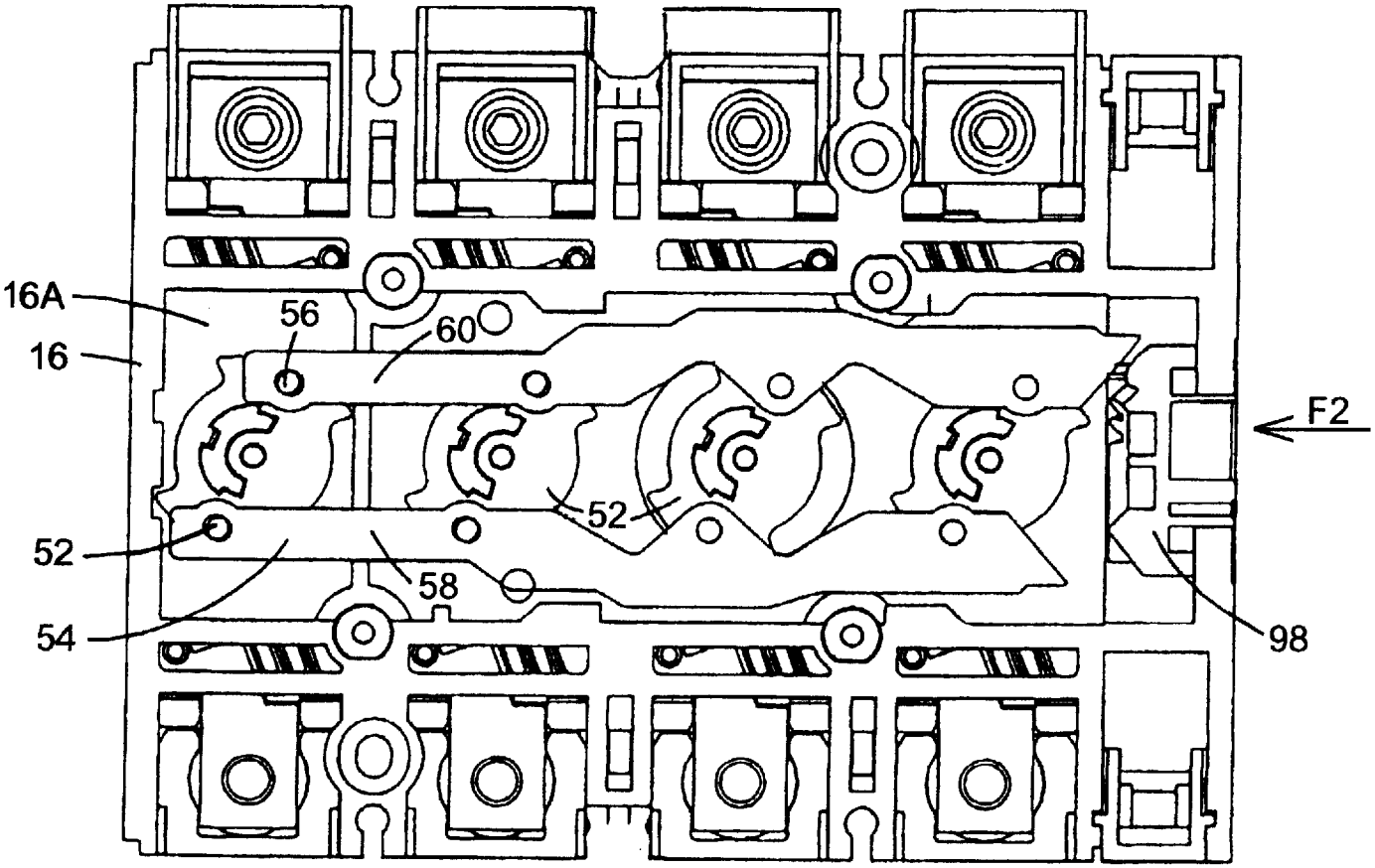
FIG. 3 represents a plan view of the switch after the cover and operating mechanism have been removed.
Figure 4:
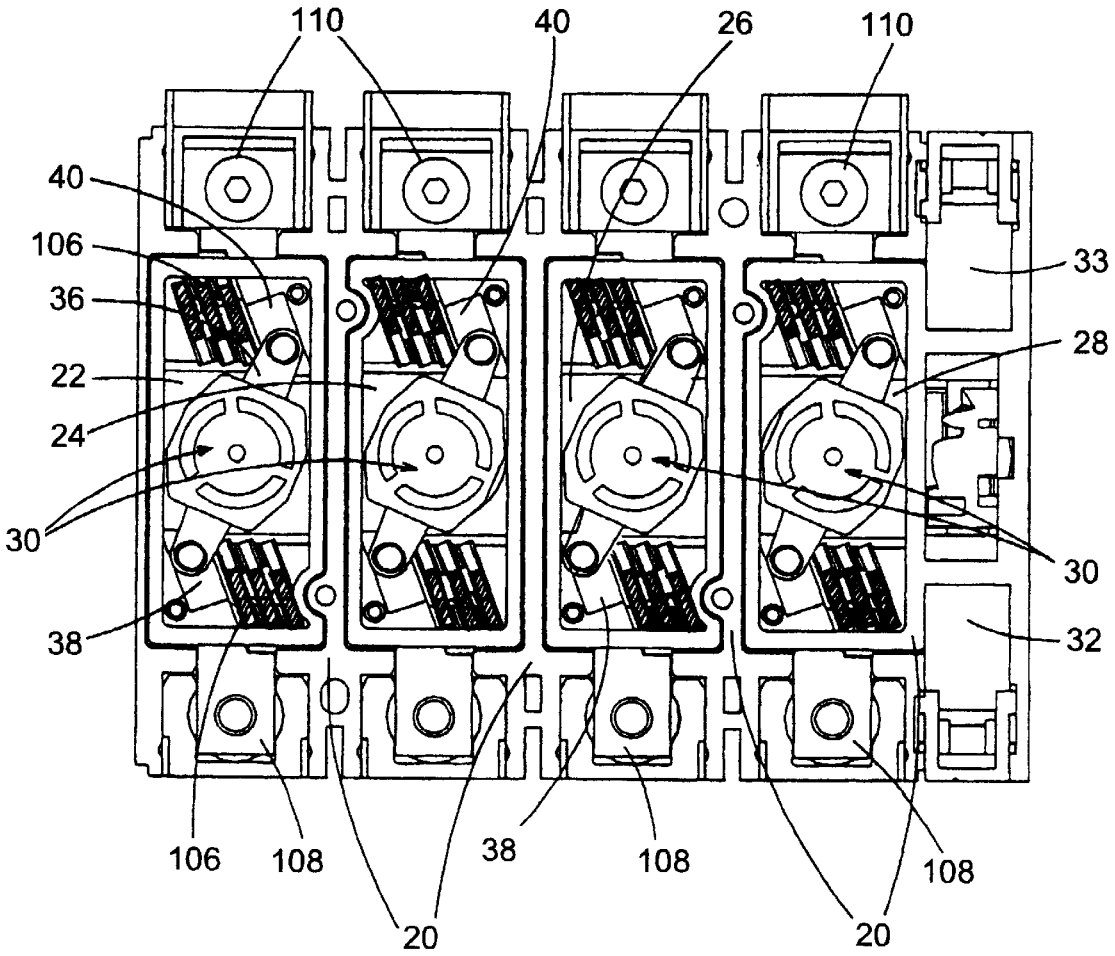
FIG. 4 is a plan view of the switch after the intermediate housing has been removed.

Separation of the contacts for opening of the switch is achieved by making the operating handle 86 pivot a quarter of a turn. The rotation of the main pinion 84 causes a change of state of the double toggle device 66 and moves the actuating rods 58, 60 in opposite translation due to the action of the connecting rods 80, 82. In FIG. 3, the rod 58 is thus moved to the right, whereas the other rod 60 is urged in the opposite direction to the left.

The translation movement of the two actuating rods 58, 60 in opposite directions takes place in synchronism and causes a simultaneous rotation of the elementary switching bars 34 of all the poles. The rod 58 works in traction, whereas a thrust force is exerted on the rod 60 which works in compression during the opening phase of the switch. The mechanical stresses on the rods 58, 60 are reversed during the closing phase.

At the beginning of the opening travel, the arc arising between the contacts 36, 38; 36, 40 is quickly extinguished due to the presence of the arc extinguishing chambers 106.

The same standard elements can be used to achieve a three-pole switch. The switching bars 34 are identical, the rods 58, 60 simply having to be replaced by shorter rods, and a case with three single-pole compartments to be used.

We claim:

1. A multiple electrical switch comprising:

an operating mechanism for actuating the multiple electrical switch, said operating mechanism including connecting rods;

a case comprising molded insulating material and comprising a base, an intermediate housing and a cover;

a plurality of single-pole switch modules arranged in a plurality of partitioned housings within the base of said case;

each of said plurality of single-pole switch modules comprises a movable contact shaped as a bridge, and a pair of opposed stationary contacts electrically connectable with the movable contact to permit double current interruption in each of the single-pole switch modules;

transmission means coupled to said operating mechanism so that each of the movable contacts is movable in synchrony with the movable contacts of all of said plurality of single-pole switch modules;

wherein each one of said plurality of single-pole switch modules further comprises an individual switching bar that supports a movable contact of the movable contacts of the moveable contacts, said individual switching bar includes a vertical-axis rotary insulating stud having an upper end comprising drive means and a lower end comprising an end piece for guidance during rotation; and a pair of actuating rods extending parallel to each other in a horizontal plane perpendicular to said vertical-axis rotary insulating stud, said pair of actuating rods being mechanically coupled to the drive means of each of the switching bars of said plurality of single-pole switch modules, said pair of actuating rods being engageable by the connecting rods of said operating mechanism to permit movement of each of the actuating rods in opposite directions to each other, from one of an opened position to a closed position, and a closed position to an open position.

2. The switch according to claim 1, wherein the driving means of each of the switching bars further comprises:

a driving lug attached at the upper end of said switching bar;

a transmission ring surrounding said driving lug;

said pair of actuating rods having holes therein; and two pins inserted in the holes of said actuating rods, so that said transmission ring is engaged by said pair of actuating rods.

3. The switch according to claim 2 wherein one of said pair of actuating rods works in traction, and another of said pair of actuating rods works in compression, while engaging said transmission ring.

4. The switch according to claim 3, wherein said operating mechanism further comprises a double toggle device connected to the connecting rods, and a pinion device actuable by said double toggle device for one of front and lateral operation.

5. The switch according to claim 4, wherein said double toggle device comprises:

two levers articulated via an intermediate lever to the connecting rods of said operating mechanism;

a pair of fixed fingers having a circular section along which the connecting rods move; and a spring threaded onto each lever of said two levers and bearing on one of the connecting rods of said operating mechanism.

6. The switch according to claim 5, wherein the connecting rods comprise upper ends positioned in gorges of a main pinion of the pinion device.

7. The switch according to claim 6, wherein the main pinion is in mechanical connection with a conical pinion by means of a counterpinion, and a removable operating handle can be fitted to at least one of the main pinion and the conical pinion to achieve one of front control and lateral control.

8. The switch according to claim 7, comprising:

a housing in a base of a parallelpipedic-shaped case for at least one electrical auxiliary indication to display a status of one of said opened and closed positions of the switch;

an operating slide cooperating with said conical pinion for actuating a change of state of said auxiliary indication.

9. The switch according to claim 1, said case is a parallelpipedic-shaped housing formed by superposition of 1) the base containing the plurality of single-pole switch modules, 2) the intermediate housing containing the drive means of the rotary insulating stud and said pair of actuating rods, and 3) the cover for positioning said operating mechanism.

10. The switch according to claim 1, wherein the movable contact of each of the switching bars comprises two parallel conducting bars passing through apertures of the rotary insulating stud, and the two parallel conducting bars are separated from one another by a preset gap, and electrically connectable on one side with said first stationary contact that is electrically connected to a connection terminal, and on an opposite side with said second stationary contact that is electrically connected to another connection terminal of one of said plurality single-pole switch modules.

* * * * *